US009702333B1

(12) United States Patent
Bell

(10) Patent No.: US 9,702,333 B1
(45) Date of Patent: Jul. 11, 2017

(54) THERMALLY CONTROLLED IGNITION DEVICE

(71) Applicant: Peter Michael Bell, Fremont, CA (US)

(72) Inventor: Peter Michael Bell, Fremont, CA (US)

(73) Assignee: Eco-S Spark Plug Corporation, Fremont, CA (US)

( * ) Notice: Subject to any disclaimer, the term of this patent is extended or adjusted under 35 U.S.C. 154(b) by 0 days.

(21) Appl. No.: 15/084,266

(22) Filed: Mar. 29, 2016

(51) Int. Cl.
*H01T 13/14* (2006.01)
*F02P 15/00* (2006.01)
*F02P 15/08* (2006.01)
*F02P 13/00* (2006.01)

(52) U.S. Cl.
CPC ..... *F02P 15/006* (2013.01); *F02P 13/00* (2013.01); *F02P 15/08* (2013.01)

(58) Field of Classification Search
CPC H01T 13/18; H01T 13/40; F02F 1/242; F02P 5/145; F02P 19/02; F02N 2200/023
USPC ..... 123/142.5 R, 169 PB, 145 A, 143 A, 123/143 B, 179.3
See application file for complete search history.

(56) References Cited

U.S. PATENT DOCUMENTS 2,037,851 A * 4/1936 Carter ..... H01T 13/40 313/124
3,235,763 A * 2/1966 Candelise ..... H01T 13/50 313/128
3,851,637 A * 12/1974 Green ..... H01T 13/18 123/145 A
4,198,944 A * 4/1980 Heintzelman ..... F02B 19/1004 123/169 R
4,361,063 A * 11/1982 Larson ..... B23D 36/0058 318/601
5,024,534 A * 6/1991 Matsubara ..... F02P 13/00 313/10
5,363,046 A * 11/1994 Shimasaki ..... F02P 13/00 324/126
5,724,932 A * 3/1998 Antone ..... F02P 19/025 123/145 A
6,060,821 A * 5/2000 Suzuki ..... H01T 21/02 123/169 EL
7,779,813 B2 * 8/2010 Hahn ..... F02D 35/021 123/305
2005/0172940 A1 * 8/2005 Iizuka ..... F01L 1/053 123/635
2007/0289571 A1 * 12/2007 Petridis ..... F02B 1/12 123/305
2009/0159044 A1 * 6/2009 Miyao ..... F02P 5/1522 123/406.37
2010/0019571 A1 * 1/2010 Kirschner ..... H02J 1/06 307/10.1
2010/0116039 A1 * 5/2010 Ramond ..... G01L 23/221 73/114.19

* cited by examiner

*Primary Examiner* — Hung Q Nguyen
*Assistant Examiner* — Josh Campbell
(74) *Attorney, Agent, or Firm* — Geeta Kadambi; Riddhi IP LLC

(57) ABSTRACT

Embodiments of the present technology relate to a temperature controllable and variable spark plug, and method of use. An example thermally controlled ignition device may comprise at least one sensor communicatively coupled to a control module for determining whether an engine characteristic is within a desired operating range and at least one heating element for adjusting the temperature of the ignition device.

17 Claims, 6 Drawing Sheets

THERMALLY CONTROLLED IGNITION DEVICE

TECHNICAL FIELD

The present technology relates generally to a thermally controlled ignition device, and, more particularly, to a temperature controllable and variable spark plug, and method of use.

BACKGROUND

Spark plugs are widely used to ignite fuel in internal combustion engines. Currently, in order for an engine to operate smoothly, powerfully, and in an environmentally friendly manner, a number of requirements have to be met, for example, the perfect balance of fuel and air mixture must be present in the combustion chamber, and the ignition spark must leap between electrodes precisely at a pre-determined time. For this purpose, spark plugs must meet high performance requirements such as a powerful ignition spark between 500 to 3,500 times a minute (in 4-stroke operation) even during stop-and-go traffic, reliable ignition at low temperatures, low-emission combustion, optimal fuel efficiency without misfiring, and preventing fouling, pre-ignition, and detonation.

Some problems that may arise with spark plugs include, but are not limited to, fouling when the spark plug tip temperature is insufficient to burn off carbon, fuel, oil, or other deposits, more voltage required to bridge the gap between the center and ground electrodes, misfiring, and overuse of fuel. Defective spark plugs can have a negative impact on the engine and other parts of a vehicle.

It should be apparent from the foregoing that there remains a need for improvements of spark plugs, and in particular, providing a temperature controllable spark plug in combination with modern computer engine management systems to enhance engine performance and efficiency.

SUMMARY

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

According to some embodiments, the present technology is directed to a thermally controlled ignition device comprising at least one sensor communicatively coupled to a control module for determining whether an engine characteristic is within a desired operating range and at least one heating element for adjusting the temperature of the ignition device. In some embodiments, the at least one sensor comprises a thermal sensor, a voltage sensor, an oxygen sensor, a $NO_x$ sensor, or an exhaust gas sensor, and the at least one engine characteristic comprises temperature, voltage, oxygen, $NO_x$, or exhaust gas.

According to other embodiments, the present technology is directed to a corresponding method for controlling the temperature of an ignition device comprising acquiring data corresponding to at least one engine characteristic measurement by at least one sensor; transmitting the data to a control module; determining, by the control module, whether the engine characteristic is within a desired operating range; and adjusting, by the control module, the temperature of at least one heating element of the ignition device. In some embodiments, the at least one sensor comprises a thermal sensor, a voltage sensor, an oxygen sensor, a $NO_x$ sensor, or an exhaust gas sensor, and the at least one engine characteristic comprises temperature, voltage, oxygen, $NO_x$, or exhaust gas.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

The following detailed description includes references to the accompanying drawings, which form a part of the detailed description. The drawings show illustrations in accordance with exemplary embodiments. These exemplary embodiments, which are also referred to herein as "examples," are described in enough detail to enable those skilled in the art to practice the present subject matter. The embodiments can be combined, other embodiments can be utilized, or structural, logical, and electrical changes can be made without departing from the scope of what is claimed. The following detailed description is, therefore, not to be taken in a limiting sense, and the scope is defined by the appended claims and their equivalents.

Spark plugs can be used as a valuable diagnostic tool to display symptoms and conditions of an engine's performance in a variety of industries such as automotive, aviation, marine, and industrial such as in lawn mowers and chainsaws. Various factors can affect engine performance such as spark plug insulator tip length, temperature, air/fuel mixture, engine speed and load, ignition timing, ambient air temperature, and presence of deposits on the spark plug tip. These factors may result in abnormal combustion conditions such as fouling, misfiring, pre-ignition, and even detonation. Therefore, there is a need to improve spark plugs to improve fuel efficiency, make engines last longer, and reduce emissions into the air environment.

Embodiments of the present disclosure are directed to a temperature controllable and variable spark plug, and method of use. Embodiments of the present technology provide the ability to measure the temperature of a spark plug center electrode or voltage for an ignition spark to jump the gap between electrodes and then adjust and vary the temperature of a heating element of a spark plug based on the measured temperature or voltage. Another advantage of the present technology is that it can adapt to different fuels since some fuels become less volatile as they get older.

These and other advantages of the present technology are described herein with reference to the collective drawings.

Figure 1:
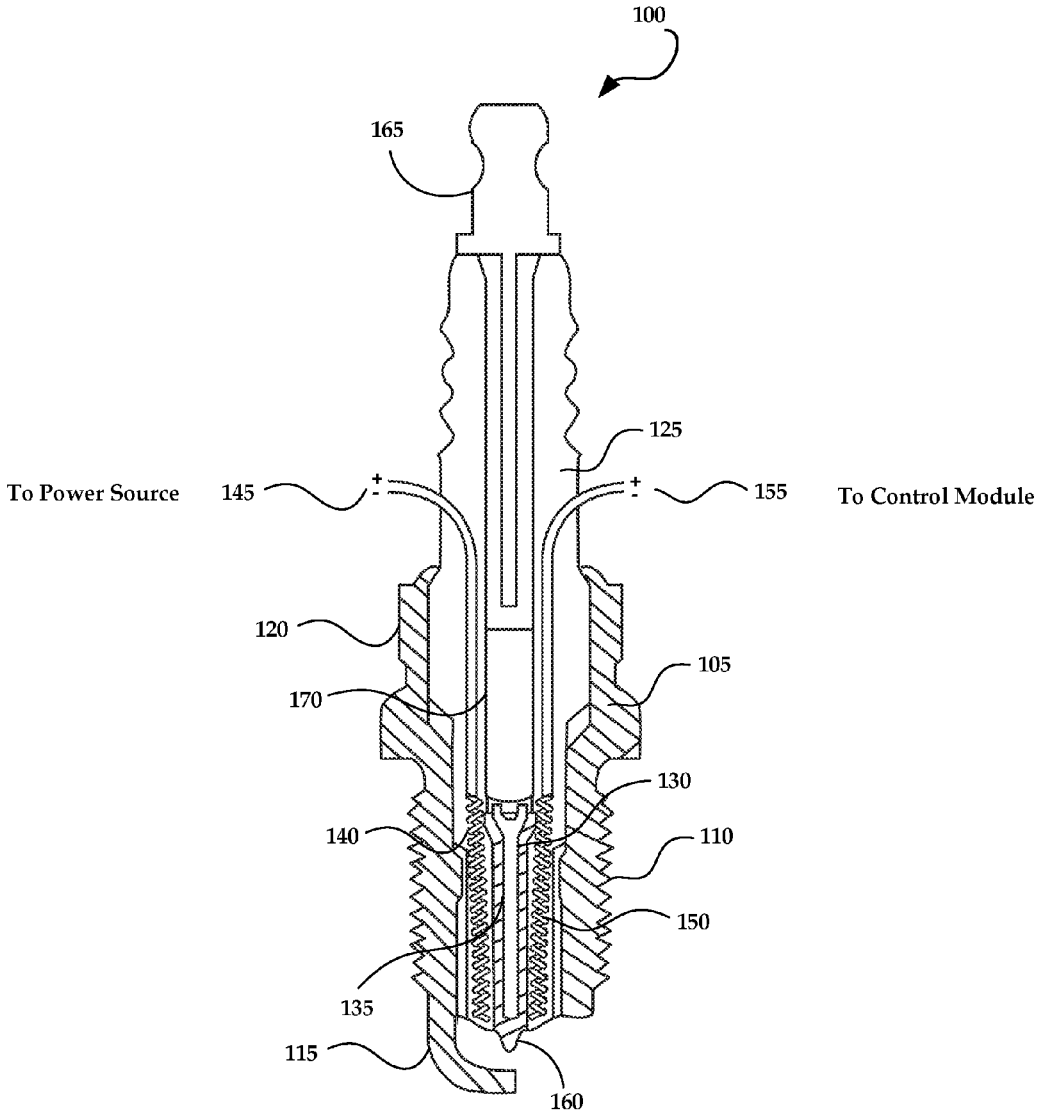
FIG. 1 is a side sectional view of a spark plug in accordance with an embodiment of the present technology.

FIG. 1 is a side sectional view of a spark plug 100 in accordance with an embodiment of the present technology. The spark plug 100 comprises a metal casing or shell 105 having an externally threaded cylindrical base 110 for threadable engagement with a cylinder head of an internal combustion engine. A ground electrode 115 is coupled, such as by welding or hot forging, to the lower surface of the threaded cylindrical base 110. In some embodiments, ground electrode 115 is made from a nickel alloy, for example, nickel chromium, or any other metal. The shell 105 may include a hexagonal boss 120 thereon to allow for grasping or turning of spark plug 100 with a tool such as a spark plug socket.

Spark plug 100 further includes ceramic insulator 125 disposed concentrically within shell 105. A center electrode 130 is disposed concentrically within insulator 125. Center electrode 130 may include a central core 135 made from a thermally conductive material such as copper. Parallel to center electrode 130 and disposed concentrically within insulator 125 is heating element 140. In some embodiments, heating element 140 can be a heated coil comprising a spirally-wound wire filament positioned in a bore of a sheath made of heat resistant metal such as stainless steel. Heating element 140 may also be any other heating means for emitting heat. For example, heating element 140 may be included in threaded cylindrical base 110 that engages with the cylinder head of an internal combustion engine. In an alternate embodiment, heating element 140 may be a window device that controls the exposure of spark plug 100 to the combustion chamber, for example by a rotating mechanism, to vary the temperature of spark plug 100 by either heating spark plug 100 or shielding and cooling spark plug 100. In various embodiments, the leads 145 of heating element 140 are connected to a power source such as a battery. In some embodiments, the power source connected to heating element 140 may be the battery of a vehicle, a battery external to the battery of a vehicle, an alternator, or any other power source.

Also parallel to center electrode 130 and disposed concentrically within insulator 125 is sensor 150. In some embodiments, sensor 150 is a temperature sensor that can be a sensor coil made of a heat resistant material, a thermocouple, or any other temperature sensor. In further embodiments, sensor 150 can be a voltage sensor, an oxygen sensor, a $NO_x$ sensor, an exhaust gas sensor, or any other sensor of engine characteristics that contribute to diagnosing the health of spark plugs and engines. In various embodiments, the leads 155 of sensor 150 are connected to a control module such as Electronic Control Module (ECM) of a vehicle or a standalone device such a personal computer (PC) or any machine capable of executing a set of instructions (sequential or otherwise) that specify actions to be taken by that machine. Further embodiments of the control module are discussed in FIG. 6. For example, sensor 150 can collect temperature data of center electrode 130 and transmit the temperature data to the control module, which determines whether the temperature of center electrode 130 is within a desired operating range, and adjusts the temperature of heating element 140 accordingly. In another example, sensor 150 can measure the voltage output at the spark plug gap between the electrode tip 160 disposed on one end of center electrode 130 and ground electrode 115. Low or high voltage may indicate the spark plug is malfunctioning, for example, by a weak spark or fouling, and temperature adjustment of heating element 140 is required.

Opposite electrode tip 160 is an electrically conductive insert or rod 165. The insert 165 fits into the upper end of ceramic insulator 125. In some embodiments, disposed between insert 165 and center electrode 130 is an internal resistor 170.

Figure 2:
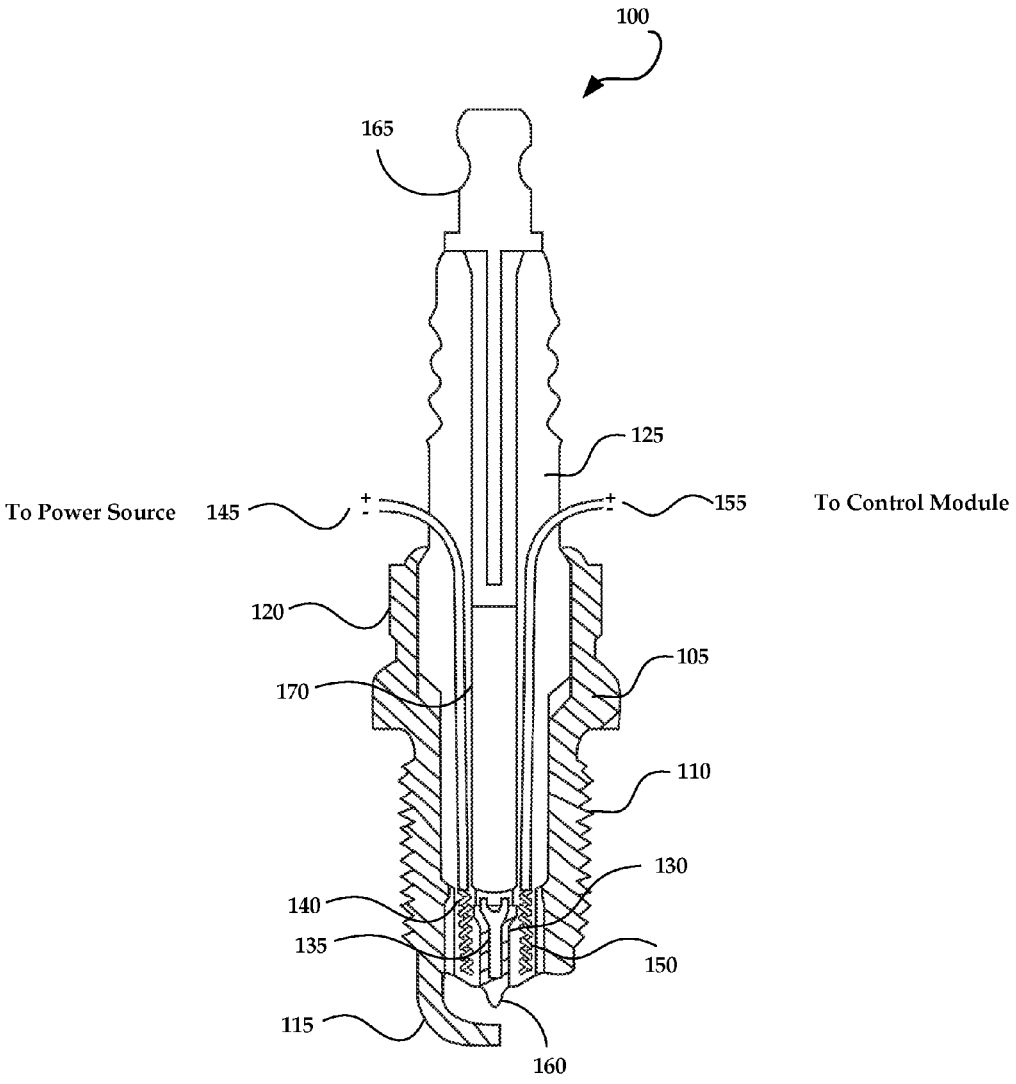
FIG. 2 is a side sectional view of a spark plug in accordance with another embodiment of the present technology.

FIG. 2 is a side sectional view of a spark plug in accordance with another embodiment of the present technology. The heat range of a spark plug is the relative temperature of the spark plug's core nose, which is in part determined by the length of the insulator tip. A cold spark plug transfers heat rapidly from its firing end into the engine cooling system and is used to avoid core nose heat saturation where combustion chamber or cylinder head temperatures are relatively high. A hot spark plug has a slower heat transfer rate and is used to avoid fouling under relatively low combustion chamber or cylinder head temperatures where a spark plug's electrode tip at the firing end becomes coated with foreign substances such as, carbon, fuel, oil, or other deposits. Fouling causes the spark plug to not provide adequate voltage to the firing tip and to not fire properly. FIG. 2 depicts an exemplary embodiment of the present technology incorporated in a cold spark plug 200 where the cold spark plug has less insulation at the tip. In the event, that the spark plug tip temperature is lower than about 500° C. where fouling may occur because it will not be hot enough to burn off carbon and combustion chamber deposits, sensor 150 can sense the temperature or voltage of the spark plug tip, transmit this information to the control module where the control module can determine that the temperature or voltage of the spark plug tip is too low such that fouling may occur, and the control module can adjust temperature of heating element 140 to heat the spark plug tip, resulting in the spark plug being self-cleaning.

Currently, many spark plugs use rare metals, such as iridium or platinum, for center electrode 130 and electrode tip 160 because these precious metals have much higher melting points over traditional metals such as nickel. However, rare metal spark plugs can cost at least two to four times as much as traditional copper and nickel spark plugs. Embodiments of the present technology can make a spark plug more efficient without requiring the use of rare metals. However, the present technology can also be combined with spark plugs using rare metals for an even more efficient spark plug. By controlling the temperature of a spark plug, the spark plug stays clean and efficient at burn.

Figure 3:
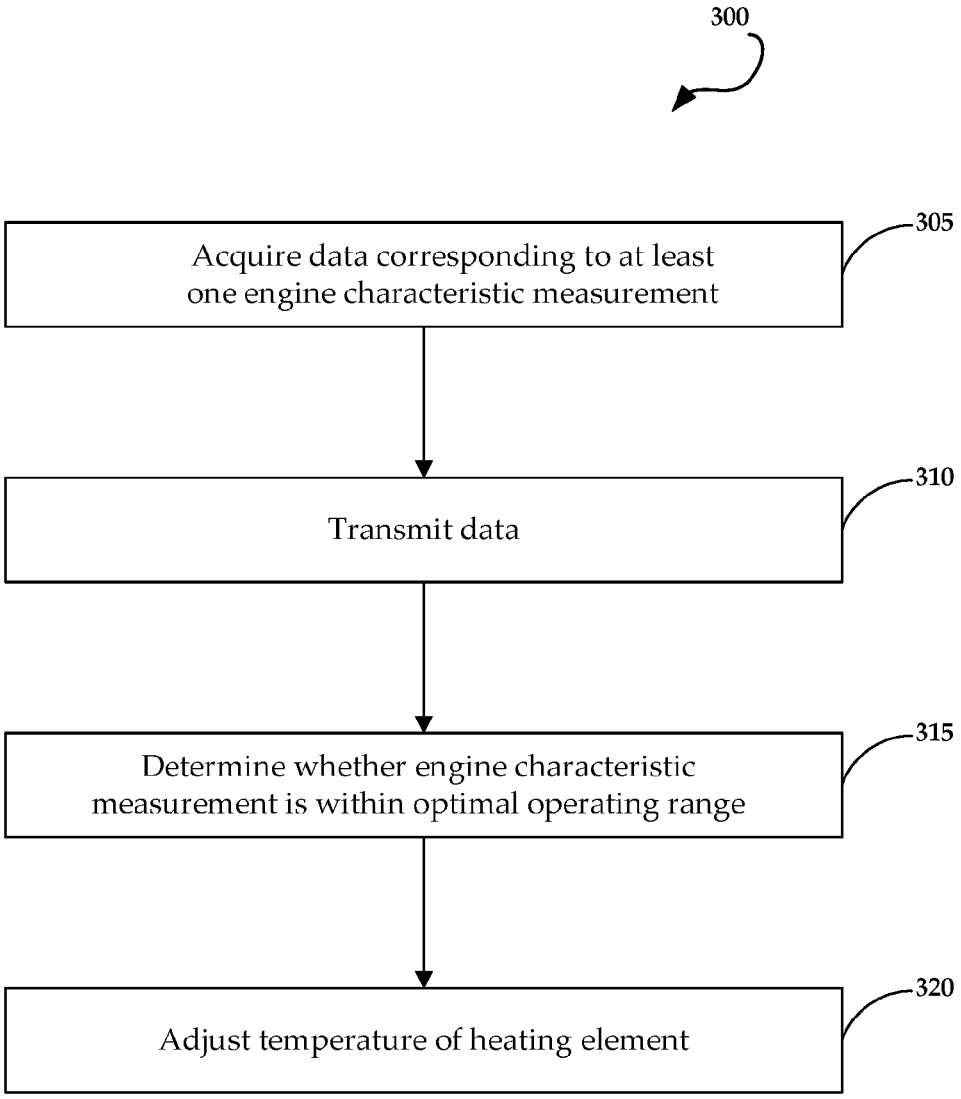
FIG. 3 is a flow chart showing an exemplary method for controlling the temperature of a spark plug in accordance with an embodiment of the present technology.

In FIG. 3, various embodiments of a method of the present disclosure are exemplified by method 300. At step 305, data corresponding to at least one engine characteristic measurement, such as temperature, voltage, oxygen, and $NO_x$, may be acquired by at least one sensor, for example, a thermocouple, a sensor coil, a voltage sensor, an oxygen sensor, a $NO_x$ sensor, or any other sensor of engine characteristics.

At step 305, the sensor transmits the data corresponding to at least one engine characteristic measurement to a control module. In some embodiments, the control module is an ECM of a vehicle, for example, when the present technology is incorporated with original equipment manufacturer (OEM) parts and applications. In another embodiment, the control module is a standalone device such as a PC when the present technology is used to retrofit or customize a vehicle aftermarket.

The control module determines at step 315 whether the engine characteristic that was sensed by the sensor is within a desired operating range according to logic programmed onto the control module. For example, if the temperature of the spark plug or voltage required to jump the gap between electrodes is not within the desired operating range, the control module will adjust the temperature of the heating element at step 320. In some embodiments, the control module adjusts the temperature of the heating element by applying a variable voltage or amperage to the heating element through a power source. For example, in cold weather locations, before firing up a vehicle engine, the temperature of the spark plug can be sensed to be too low, and the control module can indicate that the temperature of the spark plug needs to be increased by the heating element by applying a voltage or amperage to the heating element before ignition.

Figure 4:
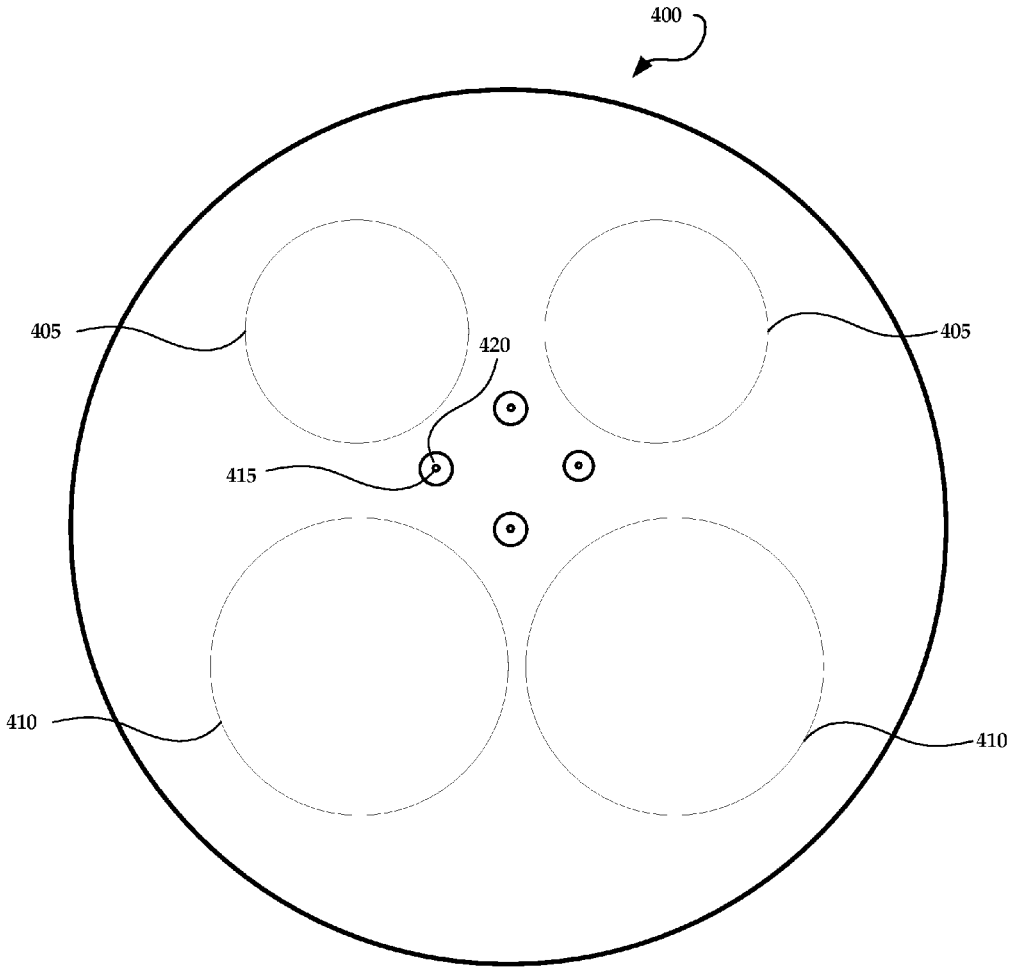
FIG. 4 is a top view of a combustion chamber with multiple temperature controllable spark points.

FIG. 4 is a top view of a combustion chamber 400 with multiple temperature controllable spark points to increase combustion efficiency. In some embodiments, a plurality of exhaust valve ports 405 and a plurality of intake valve ports 410 are molded into the cylinder head of an internal combustion engine. A temperature controllable spark point is comprised of at least a spark ignition 415 and a temperature controlled area 420. In some embodiments, spark ignition 405 can be comprised of the same ignition components of spark plug 100 in FIG. 1 such as center electrode 130, central core 135, electrode tip 160, and ground electrode 115. In various embodiments, temperature controlled area 420 may comprise at least one engine characteristic sensor and at least one heating element such as sensor 150 and heating element 140 of FIG. 1. The temperature controlled area 420 surrounding the at least one engine characteristic sensor and at least one heating element may be made from a ceramic material.

In some embodiments, the plurality of temperature controllable spark points may be permanently built into a combustion chamber, for example, by molding the temperature controllable spark points into the casting of the cylinder head such that there are no gaskets and exterior wires. Additionally, in some embodiments, a variable number of the plurality of temperature controllable spark points may be actively sparking for redundant or intermittent use of the spark points. For example, all temperature controllable spark points may be active at once, some spark points are inactive until they are needed, such as when a spark point fails, or the activity of the plurality of spark points may be rotated in order to increase the lifespan of the spark points. For example, half of the temperature controllable spark points present may be active and then deactivated in order to activate the second half of the temperature controllable spark points in order to increase the lifespan of the spark points. In various embodiments, if one or more spark points fail, the control module can sense the one or more defective spark points, perform a heated clean cycle on one or more remaining backup temperature controlled spark points to remove any fouling, and turn on one or more remaining backup spark points to keep the engine performing.

In various embodiments, the size of the temperature controllable spark points can be miniaturized, for example to the size of a button or smaller, so that the temperature controllable spark points can be placed anywhere. The temperature controllable spark points can also be made to be shallow and flush with the cylinder head so that the temperature controllable spark point does not extend into the combustion chamber. Current spark plugs cannot be used intermittently or in a redundancy because the heat source of the spark plug is a byproduct of the combustion process. With the present technology, spark points that are temperature controlled can be made into any size, can be flush with the cylinder head, and can be used in multiples intermittently or as a redundancy factor.

Additionally, multiple temperature controllable spark points give engineers the ability to design combustion chambers around the most efficient ignition of spark or in any configuration. For example, in FIG. 4, four temperature controllable spark points are placed in the center of the exhaust valve ports 405 and intake valve ports 410, surrounding the area where current spark plugs are designed to fit. In some embodiments, a control module coupled to the plurality of temperature controllable spark points can cycle through heated cleaning cycles to keep the ignition area free from combustion byproducts.

Figure 5:
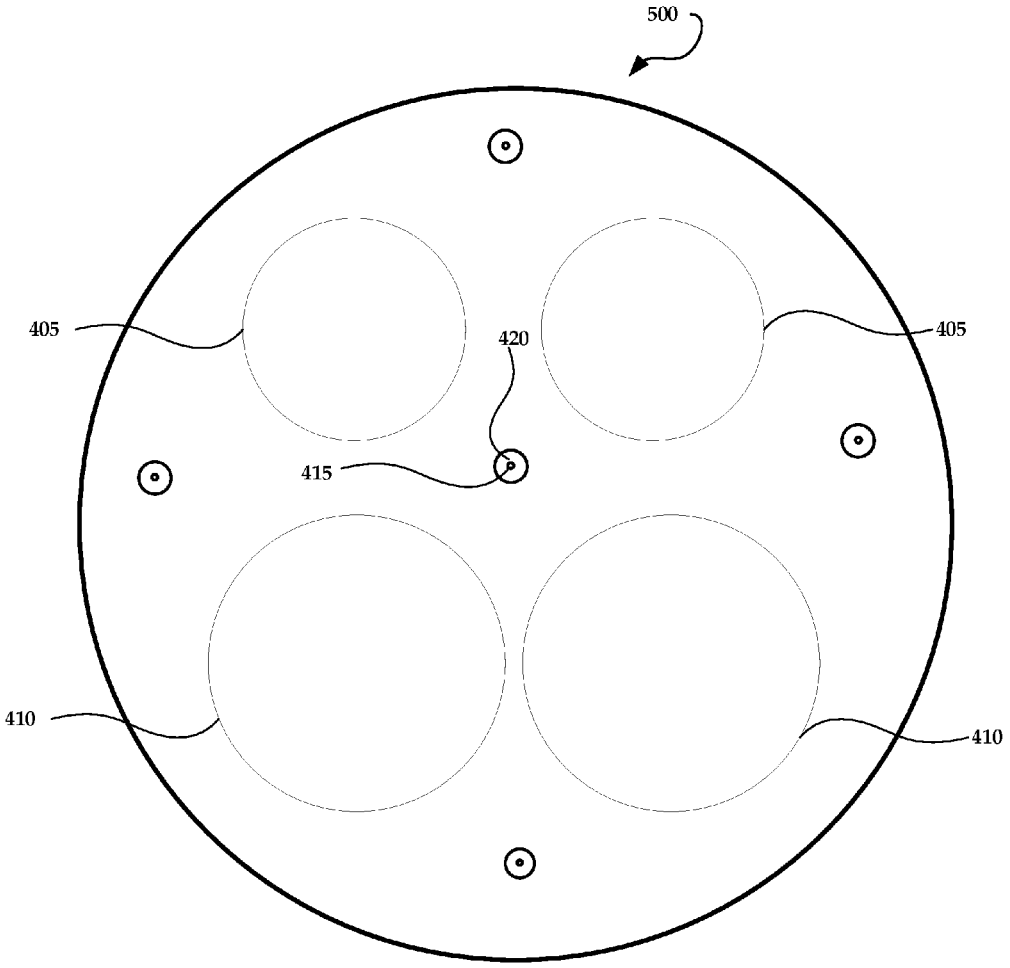
FIG. 5 is another top view of a combustion chamber with multiple temperature controllable spark points.

FIG. 5 is another top view of a combustion chamber 500 with multiple temperature controllable spark points, illustrating that the temperature controllable spark points may be placed anywhere within the cylinder head. A central spark ignition, comprising spark ignition 415 and temperature controllable area 420, is placed at the center of combustion chamber 500 with a plurality of temperature controllable spark points placed in a circle around the central spark ignition. The ignition of the temperature controllable spark points can be micro timed with the ignition moving in a circle to ensure a complete timed combustion.

Figure 6:
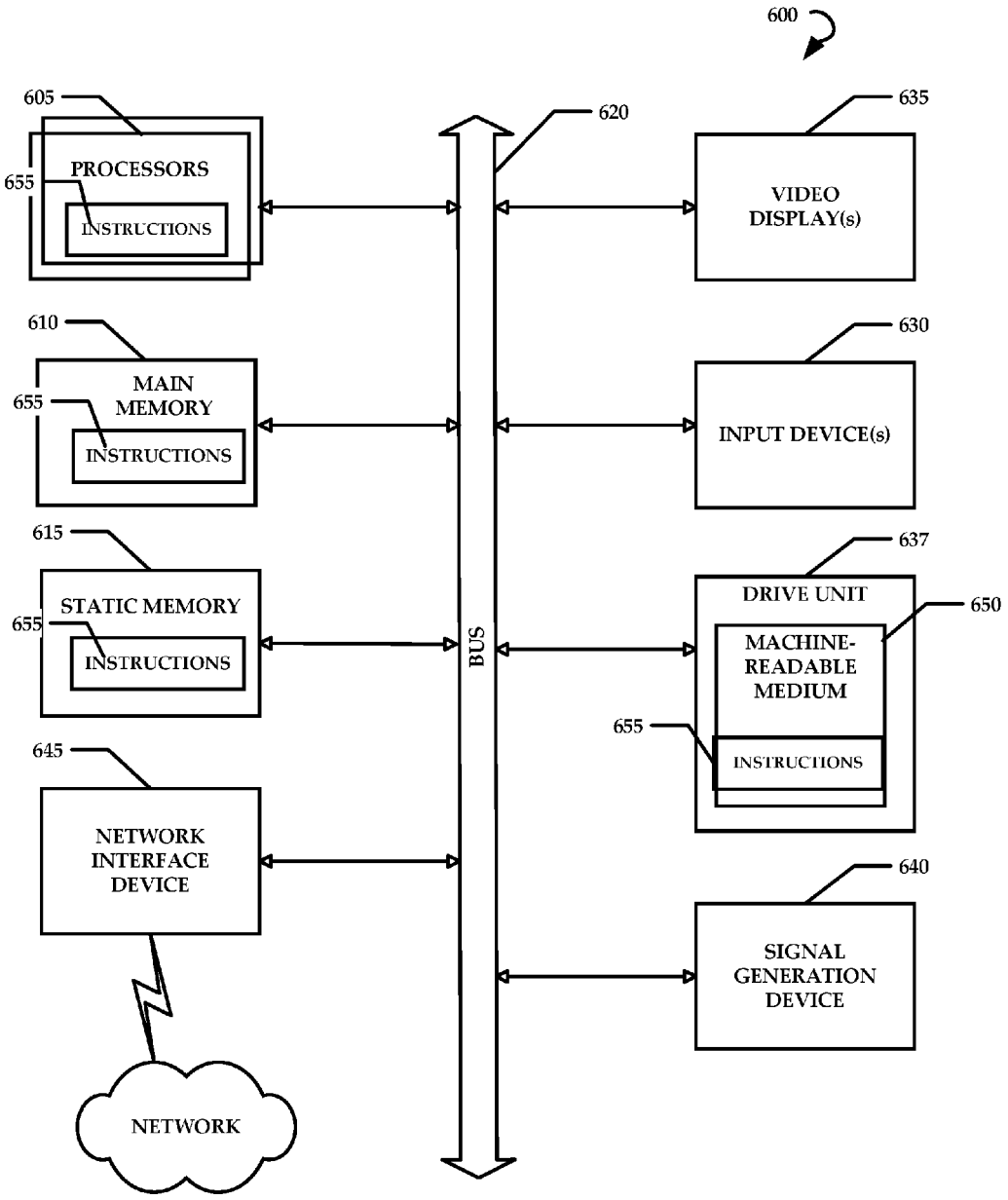
FIG. 6 is a schematic representation of a computer system or a machine, within which a set of instructions for causing the machine to perform any one or more of the methodologies discussed herein, can be executed.

FIG. 6 is a diagrammatic representation of an example machine in the form of a computer system 600 or control module that can be utilized to control the temperature of at least one spark plug, within which a set of instructions for causing the machine to perform any one or more of the methodologies discussed herein may be executed. In various example embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a PC, an ECM, a tablet PC, a set-top box (STB), a personal digital assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 600 includes a processor or multiple processors 605 (e.g., a central processing unit (CPU), a graphics processing unit (GPU), or both), and a main memory 610 and static memory 615, which communicate with each other via a bus 620. The computer system 600 may further include a video display 635 (e.g., a liquid crystal display (LCD)). The computer system 1 may also include an alpha-numeric input device(s) 630 (e.g., a keyboard), a cursor control device (e.g., a mouse), a voice recognition or biometric verification unit (not shown), a drive unit 637 (also referred to as disk drive unit), a signal generation device 640 (e.g., a speaker), and a network interface device 645. The computer system 600 may further include a data encryption module (not shown) to encrypt data.

The disk drive unit 637 includes a computer or machine-readable medium 650 on which is stored one or more sets of instructions and data structures (e.g., instructions 655) embodying or utilizing any one or more of the methodologies or functions described herein. The instructions 655 may also reside, completely or at least partially, within the main memory 610, static memory 615, and/or within the processors 605 during execution thereof by the computer system 600. The main memory 610 and the processors 605 may also constitute machine-readable media.

The instructions 655 may further be transmitted or received over a network via the network interface device 645 utilizing any one of a number of well-known transfer protocols (e.g., Hyper Text Transfer Protocol (HTTP)). While the machine-readable medium 650 is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the machine and that causes the machine to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware. For example, various operating systems, such as UNIX, LINUX, CHROME, WINDOWS, MAC OS, PALM OS, ANDROID, IOS, QNX, and other suitable operating systems, may be used.

Suitable networks may include or interface with any one or more of, for instance, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, Digital Data Service (DDS) connection, DSL (Digital Subscriber Line) connection, an Ethernet connection, an ISDN (Integrated Services Digital Network) line, a dial-up port such as a V.90, V.34 or V.34bis analog modem connection, a cable modem, an ATM (Asynchronous Transfer Mode) connection, or an FDDI (Fiber Distributed Data Interface) or CDDI (Copper Distributed Data Interface) connection. Furthermore, communications may also include links to any of a variety of wireless networks, including WAP (Wireless Application Protocol), GPRS (General Packet Radio Service), GSM (Global System for Mobile Communication), CDMA (Code Division Multiple Access) or TDMA (Time Division Multiple Access), cellular phone networks, GPS (Global Positioning System), CDPD (cellular digital packet data), RIM (Research in Motion, Limited) duplex paging network, Bluetooth radio, cellular data technologies like LTE, 2G/3G/4G, etc., or an IEEE 802.11-based radio frequency network.

The present technology may be implemented as a web-server or in a cloud-based computing environment. A cloud-based computing environment is a resource that typically combines the computational power of a large grouping of processors and/or that combines the storage capacity of a large grouping of computer memories or storage devices. For example, systems that provide a cloud resource may be utilized exclusively by their owners; or such systems may be accessible to outside users who deploy applications within the computing infrastructure to obtain the benefit of large computational or storage resources.

The cloud may be formed, for example, by a network of web servers, with each web server (or at least a plurality thereof) providing processor and/or storage resources. These servers may manage workloads provided by multiple users (e.g., cloud resource customers or other users). Typically, each user places workload demands upon the cloud that vary in real-time, sometimes dramatically. The nature and extent of these variations typically depend on the type of business associated with the user.

The present technology is described above with reference to exemplary embodiments. Therefore, other variations upon the exemplary embodiments are intended to be covered by the present technology.

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the present technology in the form disclosed. Many modifications and variations will be apparent to those of ordinary skill in the art without departing from the scope and spirit of the present technology. Exemplary embodiments were chosen and described in order to best explain the principles of the present technology and its practical application, and to enable others of ordinary skill in the art to understand the present technology for various embodiments with various modifications as are suited to the particular use contemplated.

The flowchart and block diagrams in the Figures illustrate the architecture, functionality, and operation of possible implementations of systems, methods and computer program products according to various embodiments of the present technology. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In the following description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. A thermally controlled ignition device for an internal combustion engine, comprising:

sensors communicatively coupled to a control module for determining whether each engine characteristic of a set of engine characteristics are within desired operating ranges, wherein the sensors consist of a thermal sensor, a voltage sensor, an oxygen sensor, a NOx sensor and an exhaust gas sensor; and at least one heating element for adjusting the set of engine characteristics, wherein the set of engine characteristics consist of temperature, voltage, oxygen, NOx and exhaust gas, wherein the temperature is of a spark plug center electrode, wherein the spark plug center electrode has a heating element and the heating element is located parallel to the center electrode and the thermal sensor, wherein the heating element and the thermal sensor are on opposite sides of the spark plug center electrode, wherein the voltage is for an ignition spark to jump the gap between electrodes;

wherein the at least one heating element is a heated coil, and wherein the thermal sensor is a sensor coil.

2. The thermally controlled ignition device of claim 1, wherein the control module is an electronic control module or a personal computer.

3. The thermally controlled ignition device of claim 1, wherein the ignition device is self-cleaning.

4. The thermally controlled ignition device of claim 1, further comprising a power source communicatively coupled to the control module and the at least one heating element.

5. The thermally controlled ignition device of claim 4, wherein the control module applies a voltage or amperage through the power source to the at least one heating element to vary the temperature of the at least one heating element.

6. A method for controlling the temperature of an ignition device for an internal combustion engine, comprising:

acquiring data corresponding to a set of engine characteristics by a thermal sensor, a voltage sensor, an oxygen sensor, a NOx sensor and an exhaust gas sensor;

transmitting the acquired data to a control module;

determining, by the control module, whether each engine characteristic of the set of engine characteristics are within desired operating ranges;

performing a heat and clean cycle one or more remaining backup temperature controlled spark points to remove any fouling; and adjusting, by the control module, the temperature of at least one heating element of the ignition device, wherein a heating element of the at least one heating element is located parallel to a central electrode and the thermal sensor in the ignition device, wherein the heating element and the thermal sensor are on opposite sides of the spark plug center electrode;

wherein the at least one heating element is a heated coil, and wherein the thermal sensor is a sensor coil.

7. The method of claim 6, wherein the adjusting, by the control module, the temperature of the at least one heating element of the ignition device comprises:

sending a signal to a power source communicatively coupled to the at least one heating element; and applying a voltage or amperage to the at least one heating element.

8. The method of claim 6, wherein the control module is an electronic control module or a personal computer.

9. The method of claim 6, wherein the ignition device is self-cleaning.

10. The method of claim 9, wherein the ignition device is self-cleaning by heating the ignition device until the temperature of the ignition device is at least 500° C.

11. A thermally controlled ignition device for an internal combustion engine, comprising:

a plurality of ignition points comprising:

sensors communicatively coupled to a control module for determining whether each engine characteristic of a set of engine characteristics are within desired operating ranges; and at least one heating element for adjusting the temperature of the ignition device, wherein the set of engine characteristics consist of temperature, voltage, oxygen, NOx and exhaust gas, wherein the temperature is of a spark plug center electrode, wherein the spark plug center electrode has a heating element and the heating element is located parallel to the spark plug center electrode and the thermal sensor, wherein the heating element and the thermal sensor are on opposite sides of the spark plug center electrode, wherein the voltage is for an ignition spark to jump the gap between electrodes;

wherein the at least one heating element is a heated coil, and wherein the thermal sensor is a sensor coil.

12. The thermally controlled ignition device of claim 11, wherein the plurality of ignition points are permanently built into to a combustion chamber cylinder head.

13. The thermally controlled ignition device of claim 11, wherein if one or more ignition points fails, at least one of the remaining ignition points continue to function.

14. The thermally controlled ignition device of claim 11, wherein one or more of the plurality of ignition points are active and one or more of the plurality of ignition points is inactive.

15. The thermally controlled ignition device of claim 14, wherein if one or more of the active ignition points fail, one or more inactive ignitions points are activated.

16. The thermally controlled ignition device of claim 11, wherein the plurality of ignition points are shallow such that the plurality of ignition points do not extend into the combustion chamber.

17. The thermally controlled ignition device of claim 11, wherein at least one of the plurality of ignition points are intermittently active.

* * * * *